US011268410B2

(12) United States Patent
Mysak et al.

(10) Patent No.: US 11,268,410 B2
(45) Date of Patent: Mar. 8, 2022

(54) ACTUATION APPARATUS

(71) Applicant: Eaton Intelligent Power Limited, Dublin (IE)

(72) Inventors: Yuriy Mysak, Turin (IT); Nicola Andrisani, Cumiana (IT); Emanuele Raimondi, Collegno (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/978,201

(22) PCT Filed: Mar. 6, 2019

(86) PCT No.: PCT/EP2019/055586
§ 371 (c)(1),
(2) Date: Sep. 4, 2020

(87) PCT Pub. No.: WO2019/170758
PCT Pub. Date: Sep. 12, 2019

(65) Prior Publication Data

US 2021/0040868 A1 Feb. 11, 2021

(30) Foreign Application Priority Data

Mar. 6, 2018 (GB) ..... 1803573.3

(51) Int. Cl.
*F01L 1/18* (2006.01)
*F01L 1/46* (2006.01)
*F01L 13/00* (2006.01)

(52) U.S. Cl.
CPC ..... *F01L 1/18* (2013.01); *F01L 1/185* (2013.01); *F01L 1/46* (2013.01); *F01L 13/00* (2013.01);
(Continued)

(58) Field of Classification Search
CPC ..... F01L 1/182; F01L 1/185; F01L 2001/186; F01L 1/46; F01L 13/0005;
(Continued)

(56) References Cited

U.S. PATENT DOCUMENTS 4,256,070 A 3/1981 Mueller
5,619,958 A * 4/1997 Hampton ..... F01L 1/185 123/198 F
(Continued)

FOREIGN PATENT DOCUMENTS

CN 106661974 A 5/2017
DE 102007033821 A1 1/2009
(Continued)

*Primary Examiner* — Jorge L Leon, Jr.
(74) *Attorney, Agent, or Firm* — Mei & Mark, LLP

(57) ABSTRACT

An actuation apparatus for actuating a component of a switchable valve train device of an internal combustion engine includes: a support body for mounting on a cylinder head cover of the internal combustion engine; an actuation lever mounted to the support body for pivotal movement of the actuation lever between a first position for actuation of the component and a second position for allowing de-actuation of the component; and a biasing means for urging the actuation lever from the second position towards the first position. In use, the biasing means becomes biased when an actuation source causes the actuation lever to pivot to the second position. When the actuation source attempts to actuate the component when the component is non-actuatable, the biasing means causes the actuation lever to pivot from the second position to the first position, thereby to actuate the component when the component becomes actuatable again.

18 Claims, 1 Drawing Sheet

(52) U.S. Cl.
CPC ..... *F01L 13/0005* (2013.01); *F01L 1/182* (2013.01); *F01L 2001/186* (2013.01); *F01L 2013/001* (2013.01); *F01L 2013/103* (2013.01); *F01L 2013/105* (2013.01); *F01L 2820/032* (2013.01); *F01L 2820/033* (2013.01)

(58) Field of Classification Search
CPC ..... F01L 2013/001; F01L 2013/103; F01L 2013/105; F01L 2820/032; F01L 2820/033
USPC ..... 123/90.27, 90.39, 90.41, 90.43, 90.44
See application file for complete search history.

(56) References Cited

U.S. PATENT DOCUMENTS 5,623,897 A * 4/1997 Hampton ..... F01L 13/0005 123/90.16
5,653,198 A * 8/1997 Diggs ..... F01L 1/185 123/90.16
5,682,848 A 11/1997 Hampton et al.
5,690,066 A * 11/1997 Hampton ..... F01L 1/185 123/90.16
6,499,451 B1 * 12/2002 Hendriksma ..... F01L 1/08 123/90.16
6,591,798 B2 * 7/2003 Hendriksma ..... F01L 1/267 123/90.16
2017/0236630 A1 8/2017 Kank et al.
2020/0224560 A1 * 7/2020 Schott ..... F01L 13/0036

FOREIGN PATENT DOCUMENTS

JP S5970842 A 4/1984
WO WO 2013156610 A1 10/2013
WO WO-2015181264 A1 * 12/2015 ..... F01L 1/14
WO 2016028465 A1 2/2016
WO 2016028812 A1 2/2016
WO 2016028824 A1 2/2016
WO WO-2017144706 A1 * 8/2017 ..... F01L 13/0005
WO WO 2017144706 A1 8/2017

* cited by examiner

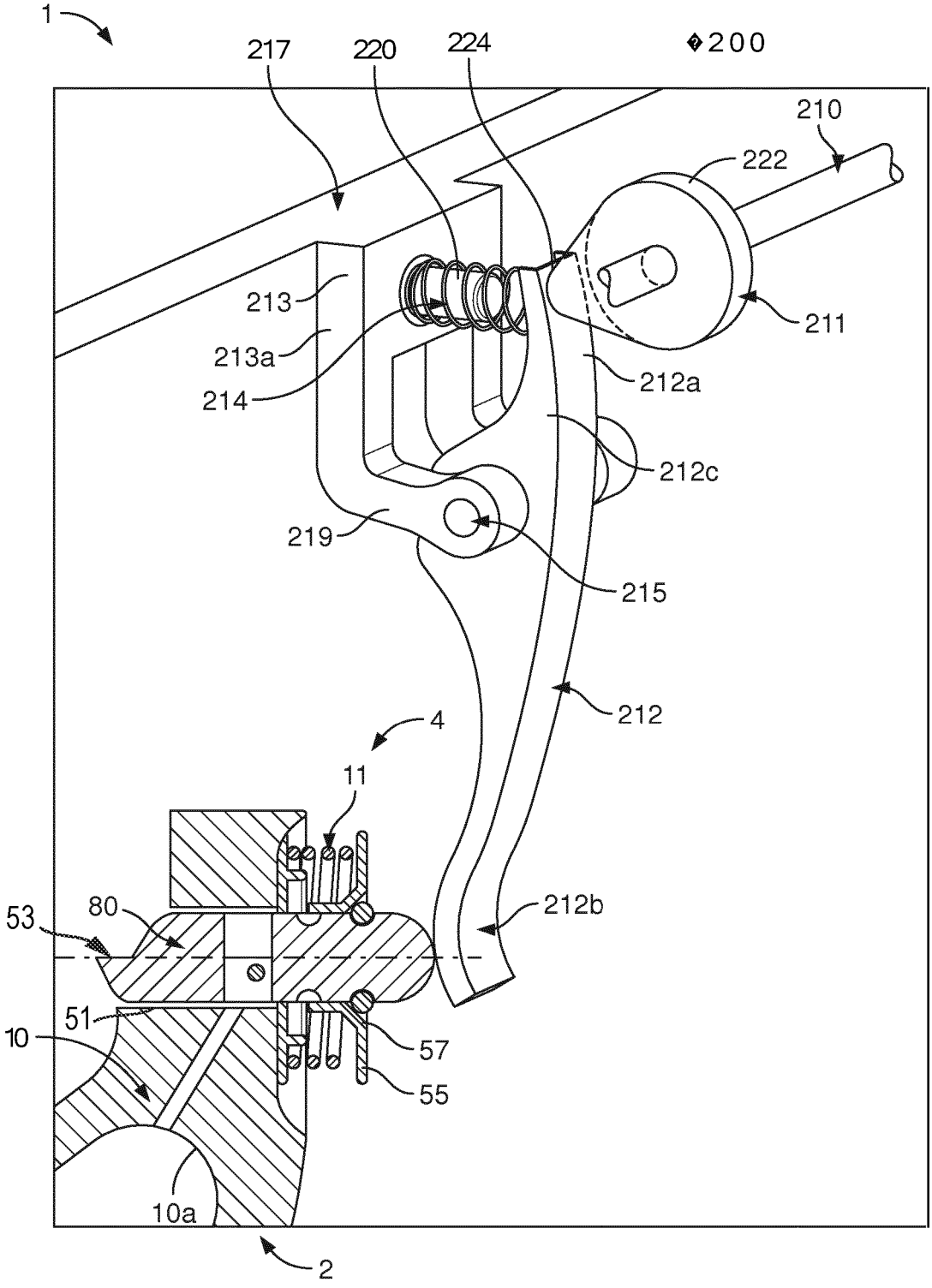
1
217
220
224
200
210
222
213
211
213a
212a
214
212c
219
215
212
4
11
212b
53
80
51
10
57
55
10a
2

ACTUATION APPARATUS

CROSS-REFERENCE TO PRIOR APPLICATIONS

This application is a U.S. National Phase application under 35 U.S.C. § 371 of International Application No. PCT/EP2019/055586, filed on Mar. 6, 2019, and claims benefit to British Patent Application No. GB 1803573.3, filed on Mar. 6, 2018. The International Application was published in English on Sep. 12, 2019 as WO 2019/170758 under PCT Article 21(2).

FIELD

The present invention relates to actuation, and more specifically actuation of components of switchable valve train devices of an internal combustion engine.

BACKGROUND

Internal combustion engines may comprise switchable engine or valve train devices. For example, valve train assemblies may comprise a switchable rocker arm (also referred to as a switchable finger follower) to provide for control of valve actuation by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

WO 2013/156610 A1 [EATON SRL] discloses such a switchable rocker arm with a moveable latch pin. The default position of the latch pin is unlatched, and it is retained in this position using biasing means. When required, the latch pin is actuated to the latched position using an external actuation mechanism based on a leaf spring. When actuation is required, the leaf spring is controlled to rotate a certain amount so as to engage with a roller of the latch pin, and hence push the latch pin into the latched position. In this way, the mode of operation that the switchable rocker arm provided for is controlled, for example, to provide for internal Exhaust Gas Recirculation.

Implementation of actuation of switchable rocker arms can be difficult due to the tight packaging constraints associated with internal combustion engines.

SUMMARY

In an embodiment, the present invention provides an actuation apparatus for actuating a component of a switchable valve train device of an internal combustion engine, the actuation apparatus comprising: a support body for mounting on a cylinder head cover of the internal combustion engine; an actuation lever mounted to the support body for pivotal movement of the actuation lever between a first position for actuation of the component and a second position for allowing de-actuation of the component; and a biasing means configured to urge the actuation lever from the second position towards the first position, wherein the apparatus is configured such that, in use, the biasing means becomes biased when an actuation source causes the actuation lever to pivot to the second position, and wherein when the actuation source attempts to actuate the component when the component is non-actuatable, the biasing means causes the actuation lever to pivot from the second position to the first position, thereby to actuate the component when the component becomes actuatable again.

BRIEF DESCRIPTION OF THE DRAWINGS

The present invention will be described in even greater detail below based on the exemplary FIGURES. The invention is not limited to the exemplary embodiments. Other features and advantages of various embodiments of the present invention will become apparent by reading the following detailed description with reference to the attached drawings which illustrate the following:

FIG. 1 illustrates schematically a valve train assembly according to an example.

DETAILED DESCRIPTION

According to a first aspect of the present invention, there is provided an actuation apparatus for actuating a component of a switchable valve train device of an internal combustion engine, the actuation apparatus comprising: a support body for mounting on a cylinder head cover of the internal combustion engine; an actuation lever mounted to the support body for pivotal movement of the actuation lever between a first position for actuation of the component of the switchable valve train device and a second position for allowing de-actuation of the component of the switchable valve train device; and a biasing means arranged to urge the actuation lever from the second position towards the first position; wherein the apparatus is arranged such that, in use, the biasing means becomes biased when an actuation source causes the actuation lever to be in the second position; and when the actuation source attempts to actuate the component when the component of the switchable valve train device is non-actuatable, the biasing means causes the actuation lever to pivot from the second position to the first position, thereby to actuate the component of the switchable valve train device, when the component becomes actuatable again.

The actuation apparatus may be arranged such that, in use, when the actuation apparatus attempts to actuate the component and the component of the switchable valve train device is actuatable, the biasing means causes the actuation lever to pivot from the second position to the first position, thereby to actuate the component of the switchable valve train device, substantially immediately.

The actuation lever may be pivotally mounted to the support body at or towards a central portion of the actuation lever, and the biasing means may contact the actuation lever at a first end portion of the actuation lever, thereby to urge pivotal movement of the actuation lever towards the first position.

The biasing means may contact the support body and may be arranged to urge the first end portion of the actuation lever away from the support body, thereby to urge pivotal movement of the actuation lever towards the first position.

A second end portion of the actuation lever, on an opposite side of the central portion to the first end portion of the actuation lever, may be arranged to contacting the component of the switchable valve train device.

The actuation apparatus may comprise the cylinder head cover of the internal combustion engine, and the support body may be mounted on the cylinder head cover.

The support body may comprise a main body for mounting the cylinder head cover of the internal combustion engine, and one or more support wings extending from the main body and to which the actuation lever is pivotally mounted.

The actuation apparatus may comprise: a shaft rotatable by the actuation source; and a lobed cam mounted on the shaft; and the apparatus may be arranged such that, in use, the biasing means becomes biased when the actuation source rotates the shaft so that a lobed profile of the lobed cam contacts the actuation lever thereby to cause the actuation lever to pivot from the first position so as to be in the second position.

The apparatus may be arranged such that, in use, the actuation source attempts to actuate the component when the actuation source rotates the shaft so that a base circle of the lobed cam contacts or is orientated towards the actuation lever.

The shaft may be supported by a support portion of the cylinder head cover of the internal combustion engine.

According to a second aspect of the present invention, there is provided a valve train assembly comprising the actuation apparatus according to the first aspect; and the switchable valve train device.

The switchable valve train device may be a switchable rocker arm comprising a first body and a second body, and the component of the switchable rocker arm may be a latching arrangement comprising a moveable latch pin for latching the first body and the second body together.

The valve train assembly may be arranged such that, in use, when the actuation lever is moved from the second position to the first position, the actuation lever actuates the latching arrangement of the rocker arm so as to move the latch pin from an unlatched position in which the first body and the second body are unlatched so that the first body and the second body are moveable relative to one another so that the switchable rocker arm is configured for a second mode of operation, to a latched position in which the first body and the second body are latched together so that the switchable rocker arm is configured for a first mode of operation.

The second mode of operation may be cylinder deactivation.

The latching arrangement may comprise a biasing element arranged to urge the latch pin from the latched position to the unlatched position.

Further features and advantages of the invention will become apparent from the following description of examples of the invention which is made with reference to the accompanying drawings.

Referring to FIG. 1, a valve train assembly 1 of an internal combustion engine comprises an actuation apparatus 200. The actuation apparatus 200 is arranged to actuate a component 4 of a switchable valve train device 2 of the valve train assembly 1. In this example, the switchable valve train device 2 is a switchable rocker arm 2, and the component 4 of the switchable rocker arm 2 is a moveable latching arrangement 4 of the rocker arm 2.

It should be noted that in FIG. 1, for economy of representation, the actuation apparatus 200 is shown in perspective view, whereas the rocker arm 2 is shown in cross section. It will be readily appreciated however that in practice, for example as described herein, the rocker arm 2 and the actuation apparatus 200 may be suitably aligned with one another, for example such that the longitudinal axes of the axle 215 and/or the shaft 210 of the actuation apparatus 200 (described in more detail below) are perpendicular to the plane through which the cross section of the rocker arm 2 is taken in the schematic illustration of FIG. 1.

The switchable rocker arm 2 is arranged to control opening and closing of a valve, for example an exhaust valve, of a cylinder of an overall internal combustion engine. The latching arrangement 4 comprises a moveable latch pin 80 for latching an inner body and an outer body 10 of the rocker arm 2 together.

Switchable rocker arms having moveable latch pins are known per se, see e.g. WO 2013/156610 A1 [EATON SRL]. In this example, the inner body and the outer body 10 may be latched together by the moveable latch pin 80 to provide a first mode of operation (e.g. a first valve-lift mode, e.g. a single lift mode where the valve is opened for example once per engine cycle, for example to provide for a "normal" engine operation mode) and unlatched, and hence can pivot with respect to each other, to provide a second mode of operation (e.g. a second valve-lift mode, e.g. a deactivation mode where the valve is not opened during the engine cycle, for example to provide for cylinder deactivation (CDA)).

Specifically, in this example, the outer body 10 and the inner body are pivotally connected together at a pivot axis. A first end of the outer body 10 contacts a valve stem of the valve and a second end 10*a* of the outer body 10 contacts a hydraulic lash adjuster (HLA). The outer body 10 is arranged to move or pivot about the HLA.

The rocker arm 2 further comprises at the second end of the outer body 10 the latching arrangement 4 comprising the latch pin 80. The latch pin 80 is slidably received in a bore 51 of the outer body 10 of the rocker arm 2. The latch pin defines a contact surface 53 for engaging with a corresponding surface of the inner body for latching the inner body and the outer body 10 together.

The inner body may be provided with an inner body cam follower, for example, a roller follower for following a lift cam. The outer body 10 may be provided with a pair of roller followers, for example slider pads arranged either side of the roller follower of the inner body, for contacting a portion of the camshaft on which the lift cam is mounted.

The latch pin 80 is moveable between a first position in which the outer body 10 and the inner body are unlatched and hence can pivot with respect to each other about the pivot axis 11 and a latched position in which the outer body 10 and the inner body are latched together and hence can move or pivot about the HLA as a single body. For example, when the inner body and the outer body 10 are unlatched and a lobe of a lift cam engages the inner body roller follower, the inner body may pivot relative to the outer body against a return spring arrangement so as to absorb as "lost motion" the lobe of the lift cam and hence no valve event may occur, whereas when the inner body and the outer body 10 are latched together, the lobe of the lift cam engaging the roller follower of the inner body may cause the inner body and outer body 10 to pivot about the HLA as a single body, which may in turn cause a valve event to occur. The rocker arm 2 may further comprise a return spring arrangement for returning the inner body to its rest position after it is has pivoted with respect to the outer body 10.

The latching arrangement 4 comprises a biasing element 11 that biases the latch pin 80 to the unlatched position. Therefore, in a default state, the latch pin 80 is urged by the biasing element 11 to its default unlatched position. The biasing element 11 contacts at a first end the outer body 10 of the rocker arm 2 and contacts at a second end a lip 55 of a contact portion 57, through which the latch pin 80 is received and to which the latch pin 80 is connected.

It will be appreciated that in some examples, the rocker arm 2 may be any rocker arm comprising a plurality of bodies that move relative to one another, which are latched together to provide one mode of operation (valve-lift mode) and are unlatched, and hence can move with respect to each other to provide a second mode of operation (valve-lift mode). For example, rocker arm 2 may be configured for internal Exhaust Gas Recirculation (iEGR), Cylinder Deactivation (CDA), Early Exhaust Valve Opening (EEVO), or the like.

The actuation apparatus 200 is for actuating the latching arrangement 4 of the switchable rocker arm 2. For example, actuation of the latching arrangement 4 may be controlled when it is desired to change the mode of operation of the rocker arm 2, for example as described above.

The actuation apparatus 200 comprises a support body 213, an actuation lever 212 mounted to the support body 213 for pivotal movement relative to the support body 213, and a biasing means 214 (also referred to herein as a compliance spring 214). The actuation apparatus 200 also comprises an actuation source, for example an electrical motor or hydraulic motor or other suitable means, a shaft 210 that is rotatable by the actuation source, and a lobed cam 211 mounted on the shaft 210.

The actuation lever 212 is mounted to the support body 213 for pivotal movement relative to the support body 213 between a first position for actuation of the latching arrangement 4 and a second position (as illustrated in FIG. 1) for allowing de-actuation of the latching arrangement 4. The biasing means 214 is arranged to urge or preload the actuation lever 212 from the second position towards the first position.

In overview, and as described in more detail below, the apparatus 200 is arranged such that, in use, the biasing means 214 becomes biased when an actuation source causes the actuation lever 212 to pivot to the second position; and when the actuation source attempts to actuate the latching arrangement 4 when the latching arrangement 4 is non-actuatable, the biasing means 214 causes the actuation lever 212 to pivot from the second position to the first position, thereby to actuate the latching arrangement 4, when the component 4 becomes actuatable again.

The actuation lever 212 is pivotally mounted to the support body 213 at or towards a central portion 212*c* of the actuation lever 212. The support body 213 is mounted on (and therefore supported by) a cylinder head cover 217 of the internal combustion engine. Specifically, the support body 213 comprises a main body 213*a* mounted on the cylinder head cover 217 of the internal combustion engine. The support body 213 comprises two support wings 219 (only one is visible in FIG. 1) extending from the main body 213*a* and located at either side of the actuation lever 212. The actuation lever 212 is pivotally mounted to the support body 213 via an axle 215 supported by the support wings 219.

The biasing means 214 is a coil spring 214 that is supported by a protrusion 220 of the main body 213*a*. A first end of the biasing means 214 contacts the support body 213, and a second end of the biasing means contacts the actuation lever 212 at a first end portion 212*a* of the actuation lever 212. The biasing means 214 therefore biases the first end portion 212*a* of the actuation lever 212 away from the support body 213, thereby urging rotation of the actuation lever 212 towards the first position. A second end portion 212*b* of the actuation lever 212, located on an opposite side of the central portion 212*c* to the first end portion 212*a* of the actuation lever 212, is arranged for contacting the latching arrangement 4 of the rocker arm 2.

The lobed cam 211 mounted on the shaft 210 is aligned with the actuation lever 212 and is arranged for contacting the first end portion 212*a* of the actuation lever 212. The lobed cam 211 comprises a base circle portion 222 and a lobed profile 224. The shaft is supported by a support portion of the cylinder head cover 217 of the internal combustion engine.

The biasing means 214 becomes biased (i.e. compressed, energised) when the actuation source causes the actuation lever 212 to be in the second position. Specifically, when the actuation source rotates the shaft 210 such that the lobed profile 224 of the lobed cam 211 contacts or pushes the first end portion 212*a* of the actuation lever 212, the actuation lever 212 is caused to pivot from the first position so as to be in the second position, which biases the biasing means 214. The latch pin 80 of the latching arrangement 4 may then move under the force of the biasing element 11 of the latching arrangement 4 so that the latch pin 80 is in the unlatched (de-actuated) position.

The actuation source may be controlled by a control unit. The actuation source may be controlled to cause the actuation lever 212 to pivot from the first position so as to be in the second position, for example when the engine control unit decides that the latching arrangement 4 is to be de-actuated, for example so that the rocker arm 2 provides for the second mode of operation (e.g. for cylinder deactivation).

When the actuation source does not cause the actuation lever 212 to be in the second position (i.e. when actuation of the latching arrangement 4 is desired), the biasing means 214 can cause the actuation lever 212 to pivot from the second position to the first position, thereby to actuate the latching arrangement 4. Specifically, when the shaft 210 is rotated by the actuation source such that the base circle 222 of the lobed cam 211 contacts or is orientated towards the actuation lever 212, the actuation lever 212 may (e.g. has the space to) pivot to the first position under the force of the biasing means 214. The biasing means 214 is stronger than the biasing element 11 of the latching arrangement 4 of the rocker arm 2, and hence the biasing means 214 can pivot the actuation lever 212 from the second position to the first portion against the force of the biasing element 11. The actuation source may be controlled to not cause the actuation lever 212 to be in the second position (i.e. controlled to attempt to actuate the latching arrangement 4), for example when the engine control unit decides that the latching arrangement 4 is to be actuated, for example so that the rocker arm 2 provides for the first mode of operation.

In cases where the latching arrangement 4 is actuatable (i.e. when the latch pin 80 is free to move), when the base circle 222 of the lobed cam 211 contacts or is orientated towards the actuation lever 212, the biasing means 214 expands so as to cause the actuation lever 212 to pivot from the second position to the first position (against the biasing element 11), thereby to actuate the latching arrangement 4. More specifically, when the actuation lever 212 is moved (by the biasing means 214) from the second position to the first position, the actuation lever 212 actuates the latching arrangement 4 of the rocker arm 2 so as to move the latch pin 80 from an unlatched position (in which the inner body and the outer body 10 are unlatched so that the inner body and the outer body 10 are moveable relative to one another so that the switchable rocker arm 2 is configured for the second mode of operation e.g. cylinder deactivation), to a latched position (in which the inner body and the outer body 10 are latched together so that the switchable rocker arm 2 is configured for the first mode of operation e.g. normal engine operation).

In these cases where the latching arrangement 4 is actuatable, the pivoting of the actuation lever 212 under the force of the biasing means 214 from the second position to the first position may occur substantially immediately, i.e. as soon as the base circle 222 of the lobed cam 211 contacts or is orientated towards the actuation lever 212.

However, in some cases, the latching arrangement may not be actuatable (i.e. non-actuatable), e.g. the latch pin 80 may not be free to move, e.g. may be blocked. For example, the actuation of the latch pin 80 may not be possible immediately due to an engine condition. For example, a lift profile of a lift cam may be engaged with the roller follower of the inner body of the rocker arm 2. In this case, the inner body will be rotated with respect to the outer body 10, hence blocking the path of the latch pin 80 from moving from the unlatched position to the latched position. In this case, when the base circle 222 of the lobed cam 211 contacts or is orientated towards the actuation lever 212, the biasing means 214 is not able to expand and instead remains compressed as the actuation lever 212 remains in the second position. As soon as (i.e. the instant that) the latching arrangement 4 becomes actuatable again, i.e. as soon as latch pin 80 becomes free to move again (i.e. becomes unblocked, e.g. as soon as the roller follower of the inner body is engaged with a base circle of the lift cam and hence the inner body is no longer blocking the path of the latch pin 80), the energy stored in the biasing of the biasing means 214 will cause the actuation lever to move from the second position to the first position, thereby actuating the latching arrangement 4.

In other words, when the actuation source attempts to actuate the latching arrangement 4 (e.g. when the actuation source rotates the shaft 210 so that the base circle 222 of the lobed cam 211 contacts or is orientated towards the actuation lever 212), and the latching arrangement is non-actuatable (e.g. the latch pin 80 is prevented from moving from the unlatched position to the latched position) the biasing means 214 causes the actuation lever 212 to pivot from the second position to the first position, thereby to actuate the latching arrangement 4, when (e.g. as soon as) the component becomes actuatable again.

As a result, the latch pin 80 is moved from the unlatched position to the latched position, hence latching the inner body and the outer body 10 together, hence switching the rocker arm 2 from the second mode of operation (e.g. cylinder deactivation) to the first mode of operation (e.g. normal operation) as described above.

As a result, regardless of the blocked or unblocked state of the latch pin 80 (i.e. regardless of whether the latching arrangement 4 is actuatable or non-actuatable), the latching arrangement 4 may be actuated as soon as it is physically possible to do so, i.e. as soon as the rocker arm 2 is not in a state which blocks actuation. This may be referred to as a compliance function of the actuation apparatus. This reduces the need to control the timing of the actuation to be synchronised with the engine cycle, and hence may provide for simpler and more efficient control.

At a later stage, the actuation source may once again rotate the shaft 210 so that the lobe profile 224 of the lobed cam 211 contacts the first end 212*a* of the actuation lever 212 (e.g. when de-actuation of the latching arrangement is again required) which causes the actuation lever 212 to rotate, against the biasing means 214, from the first position to the second position. As a result, the second end 212*b* of the actuation lever no longer exerts a substantial force to the latch pin 80. As a result, the latch pin 80 may move from the latched position to the unlatched position under the force of the biasing element 11, hence the latch pin 80 no longer latches the inner body and the outer body 10 together, and hence the rocker arm 2 is switched from the first mode of operation (e.g. normal operation) to the second mode of operation (e.g. cylinder deactivation).

As mentioned above, the actuation apparatus 200 is installed on an internal combustion engine cylinder head cover 217. That is, the support body 213 and/or the shaft 210 may be supported by (installed on, mounted on) the cylinder head cover 217 or a portion thereof.

According to the above example therefore, the actuation lever 212 is urged or preloaded by the biasing means (compliance spring) 214 mounted on the support body 213 so as to assure that the latching arrangement 4 of the rocker arm 2 is in the latched position when the actuation lever 212 contacts with a base circle 222 of the cam 211, and movement of the latching arrangement 4 to the unlatched position is allowed when the lobed profile 224 of the cam 211 pushes the actuation lever 212. Hence simple, efficient and flexible control of a switchable rocker arm (for example control of switching between normal operation mode and cylinder deactivation mode) may be provided without the need for synchronisation of the control with the engine condition.

Having the actuation lever 212 and/or the biasing means 214 mounted on the support body 213 may allow for simple installation onto the cylinder head cover, which may allow for more efficient assembly. In the example illustrated in FIG. 1, the valve train assembly 1 comprises one rocker arm 2 having a latching arrangement 4. In other examples (not illustrated) there may be a plurality of rocker arms 2 each having a respective latching arrangement 4. It will be appreciated that in these examples the actuation apparatus 200 may comprise a plurality of support bodies 213, actuation levers 212, biasing means 214, and cams 211, each associated with a respective one of the plurality of latching arrangements 4. In some examples, each of the plurality of cams 211 may be mounted on a common shaft 210 rotatable by the actuation source (as described above), and hence allow for actuation of the respective latching arrangements 4 in common. Each of the plurality of support bodies 213 (each with their associated actuation lever 212 and compliance spring 214) may be mounted on a common support for mounting to the cylinder head cover. This may allow for simple installation onto the cylinder head cover, which may allow for more efficient assembly.

Having the shaft 210 and/or the support body 213 mounted on the cylinder head cover 217 may allow for improved packaging of the switchable rocker arm functionality in the internal combustion engine. For example, having the shaft 210 mounted on the cylinder head cover 217 may reduce packaging constraint issues for example as compared to having the shaft 210 installed into the cylinder head itself and/or for example as compared to having the lobed cams 211 directly contacting latching arrangements of the rocker arms 2. This may also reduce the need to adapt the cylinder head itself to accommodate the shaft 210 and hence may allow for simpler manufacturing of the cylinder head. Having a compliance functionality provided by the biasing means 214 mounted to the support body 213 mounted to the cylinder head cover 217 may also provide improved packaging for example as compared to providing the compliance functionality in the latching arrangements 4 of the rocker arms 2 themselves. For example, not having to provide compliance functionality in the rocker arms 2 themselves allows for the packaging footprint of the rocker arms to be reduced.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1 valve train assembly
2 rocker arm
4 latching arrangement
10 outer body
10*a* second end
11 biasing element
55 lip
57 contact portion
80 latch pin
200 actuation apparatus
210 shaft
211 cam
212 actuation lever
212*a* first end portion
212*b* second end portion
212*c* central portion
213 support body
213*a* main body
214 biasing means (compliance spring)
215 axle
217 cylinder head cover
219 support wing
220 protrusion
222 base circle
224 lobed profile

The invention claimed is:

1. An actuation apparatus for actuating a component of a switchable valve train device of an internal combustion engine, the actuation apparatus comprising:

a support body;

an actuation lever comprising a central portion, a first end portion at one side of the central portion, and a second end portion at an opposing side of the central portion, the actuation lever being pivotally mounted to the support body, and pivotally moving between a first position configured to actuate the component and a second position configured for de-actuation of the component;

an actuation source configured to cause the actuation lever to pivot from the first position to the second position; and a biasing means configured to urge the actuation lever to pivot from the second position to the first position;

wherein the biasing means acts on the first end portion of the actuation lever and is preloaded when the actuation source causes the actuation lever to pivot to the second position, and the preloaded biasing means causes the actuation lever to pivot from the second position to the first position when the actuation source releases the actuation lever from the second position, wherein the actuation lever is pivotally mounted to the support body at the central portion of the actuation lever, and wherein the biasing means contacts the support body and acts on the first end portion of the actuation lever so as to urge the first end portion away from the support body such that the actuation lever is urged towards the first position.

2. The actuation apparatus according to claim 1, wherein the biasing means causes the actuation lever to pivot from the second position to the first position substantially immediately when the actuation source releases the actuation lever from the second position.

3. The actuation apparatus according to claim 1, wherein the second end portion of the actuation lever is configured to contact the component.

4. The actuation apparatus according to claim 1, further comprising a cylinder head cover, wherein the support body is mounted on the cylinder head cover.

5. The actuation apparatus according to claim 4, wherein the support body comprises a main body mounted on the cylinder head cover and one or more support wings extending from the main body, wherein the one or more support wings pivotally support the actuation lever.

6. The actuation apparatus according to claim 1, further comprising:

a shaft; and a lobed cam mounted on the shaft, wherein the biasing means is preloaded when the shaft is rotated such that a lobed profile of the lobed cam contacts the actuation lever so as to cause the actuation lever to pivot from the first position to the second position.

7. The actuation apparatus according to claim 6, wherein the actuation source releases the actuation lever from the second position when the shaft is rotated such that a base circle of the lobed cam contacts or is orientated towards the actuation lever.

8. The actuation apparatus according to claim 6, wherein the shaft is supported by a support portion of the cylinder head cover.

9. A valve train assembly, comprising:

the actuation apparatus according to claim 1.

10. The valve train assembly according to claim 9, wherein the switchable valve train device is a switchable rocker arm comprising a first body and a second body, and wherein the component is a latching arrangement comprising a moveable latch pin.

11. The valve train assembly according to claim 10, wherein when the actuation lever is in the first position, the latch pin is in a latched position in which the first body and the second body are latched together such that the switchable rocker arm is configured for a first mode of operation, and wherein when the actuation lever is in the second position, the latch pin is in an unlatched position in which the first body and the second body are unlatched such that the switchable rocker arm is configured for a second mode of operation.

12. The valve train assembly according to claim 11, wherein the second mode of operation is a cylinder deactivation mode.

13. The valve train assembly according to claim 11, wherein the latching arrangement further comprises a biasing element configured to urge the latch pin from the latched position to the unlatched position.

14. The valve train assembly according to claim 9, wherein the switchable rocker arm comprises a plurality of bodies that move relative to one another, and wherein the plurality of bodies are alternately latched together and unlatched from each other so as to provide a first mode of operation and a second mode of operation, respectively.

15. The actuation apparatus according to claim 1, wherein the first end portion of the actuation lever comprises a first surface and a second surface, wherein the actuation source acts on the first surface so as to cause the actuation lever to pivot from the first position to the second position, and the biasing means acts on the second surface so as to urge the actuation lever to pivot from the second position to the first position.

16. A valve train assembly, comprising:

a switchable valve train device comprising a plurality of rocker arms, each rocker arm including a first body, a second body, and a latching arrangement; and a plurality of actuation apparatuses respectively associated with the plurality of rocker arms, each actuation apparatus comprising:

a support body;

an actuation lever comprising a central portion, a first end portion at one side of the central portion, and a second end portion at an opposing side of the central portion, the actuation lever being pivotally mounted to the support body, and pivotally moving between a first position configured to actuate a corresponding latching arrangement of the plurality of rocker arms, and a second position configured for de-actuation of the corresponding latching arrangement;

an actuation source configured to cause the actuation lever to pivot from the first position to the second position; and a biasing means configured to urge the actuation lever to pivot from the second position to the first position;

wherein the biasing means acts on the first end portion of the actuation lever and is preloaded when the actuation source causes the actuation lever to pivot to the second position, and the preloaded biasing means causes the actuation lever to pivot from the second position to the first position when the actuation source releases the actuation lever from the second position and, wherein the actuation lever is pivotally mounted to the support body at the central portion of the actuation lever, and wherein the biasing means contacts the support body and acts on the first end portion of the actuation lever so as to urge the first end portion away from the support body such that the actuation lever is urged towards the first position.

17. The valve train assembly according to claim 16, wherein each actuation source includes a lobed cam arranged along a common shaft, and wherein in each actuation apparatus, the biasing means is preloaded when the common shaft is rotated such that a lobed profile of the lobed cam contacts the actuation lever so as to cause the actuation lever to pivot from the first position to the second position.

18. The valve train assembly according to claim 16, wherein each support body is mounted on a common support, and the common support is mounted to a cylinder head cover.

* * * * *